United States Patent [19]

Tsuji et al.

[11] 4,011,996

[45] Mar. 15, 1977

[54] SWIRL TYPE PRESSURE FUEL ATOMIZER

[75] Inventors: Shoichi Tsuji, Hoya; Minoru Asai, Kamagaya; Yuichi Fujii, Funabashi, all of Japan

[73] Assignee: Ishikawajima-Harima Jukogyo Kabushiki Kaisha, Tokyo, Japan

[22] Filed: Sept. 18, 1975

[21] Appl. No.: 614,446

Related U.S. Application Data

[62] Division of Ser. No. 405,559, Oct. 25, 1973, abandoned.

[52] U.S. Cl. ..... 239/491; 239/467; 239/518; 239/568

[51] Int. Cl.[2] ..... B05B 1/34

[58] Field of Search ..... 239/404, 406, 425, 467, 239/491, 493, 498, 502, 518, 489, 568

[56] References Cited

UNITED STATES PATENTS

| | | | |
|---|---|---|---|
| 621,480 | 3/1899 | Stevens | 239/498 X |
| 1,667,943 | 5/1928 | Munz | 239/467 X |
| 2,172,193 | 9/1939 | Downs | 239/526 X |
| 3,347,471 | 10/1967 | Halls | 239/466 |

*Primary Examiner*—John J. Love
*Attorney, Agent, or Firm*—Marvin A. Naigur; John E. Wilson; Warren B. Kice

[57] ABSTRACT

An improvement of a swirl type fuel atomizer is disclosed in which a plurality of notches are equiangularly formed around an opening of a single-nozzle hole so that the liquid fuel injected may be divided into a plurality of fuel spray patterns. The complete combustion with a relatively low temperature may be ensured so that the emission of nitrogen oxides may be substantially eliminated or reduced.

5 Claims, 5 Drawing Figures

Fig. 1
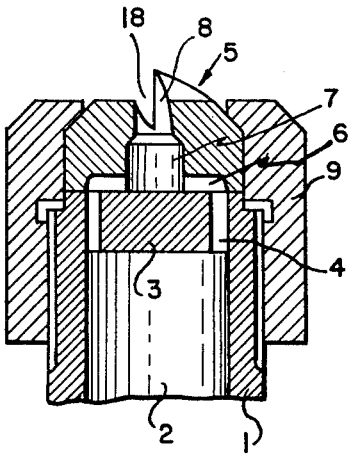
Fig. 3
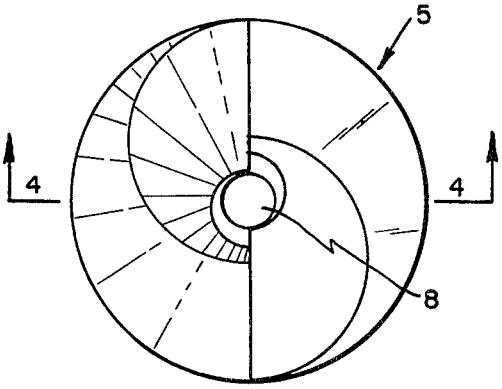
Fig. 4
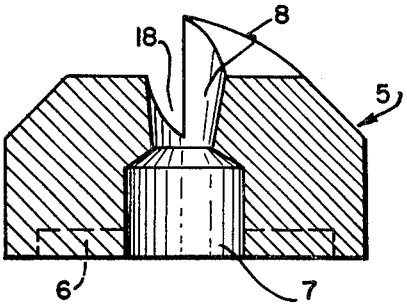
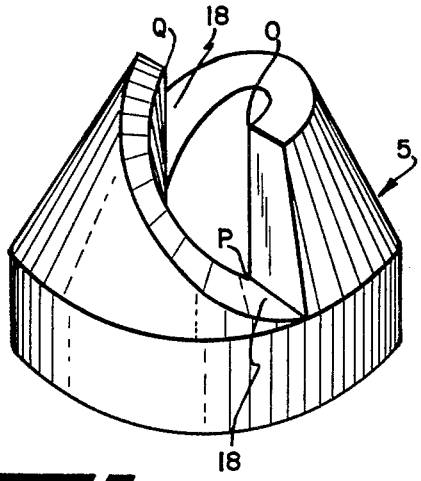
Fig. 2
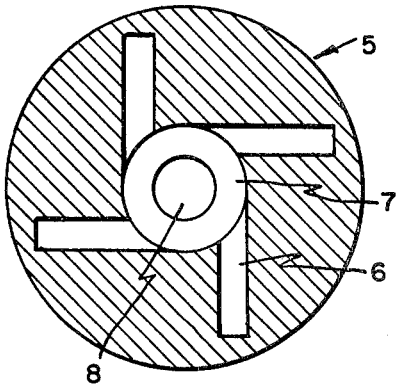
Fig. 5

SWIRL TYPE PRESSURE FUEL ATOMIZER

CROSS-REFERENCE TO RELATED APPLICATION

This is a division of application Ser. No. 405,559 filed Oct. 25, 1973, now abandoned.

The present invention relates to generally a fuel injector and more particularly an improvement of a swirl type fuel atomizer. When the conventional swirl type fuel atomizer of the type in which the swirling fuel is continuously injected through a single-nozzle hole so as to form a relatively large and single flame is produced and the flame temperature is high so that the combustion products remain within the flame for a long time, thus resulting in the increase in quantity of nitrogen oxides in the final combustion products.

One of the objects of the present invention is therefore to provide an improved swirl type fuel atomizer which may ensure the complete combustion with a relatively low temperature, thus substantially eliminating the emission of pollutants such as nitrogen oxides.

According to the aspect of the present invention, a plurality of notches are equiangularly formed around or adjacent to an opening of a single-nozzle port of a nozzle tip of a swirl type fuel atomizer so that liquid fuel injected may be divided into a plurality of fuel spray patterns. Therefore a plurality of small flames are produced so that the total surface area of the flames may be considerably increased. As a result the heat radiation is facilitated so that the flame temperature is decreased and the production of nitrogen oxides is prevented.

The above and other objects, features and advantages of the present invention will become more apparent from the following description of preferred embodiments thereof taken in conjunction with the accompanying drawing.

FIG. 1 is a sectional view of the atomizer of the present invention;

FIG. 2 is a fragmentary perspective view, on enlarged scale, of a nozzle tip thereof;

FIG. 3 is a front view thereof;

FIG. 4 is a sectional view taken along the line D-D of FIG. 4; and

FIG. 5 is a rear view of the nozzle tip.

Referring to FIG. 1, the atomizer of the present invention includes a nozzle holder 1 having a liquid fuel passage 2, a fuel guide ring 3 having liquid fuel passages 4 in communication with the fuel passage 2, a nozzle tip 5, and a nozzle assembly cap or nut 9.

The nozzle tip 5 has tangential grooves 6 in communication with the fuel passages 4 in the fuel guide ring 3 and with a swirl chamber 7 and a nozzle opening 8. The liquid fuel under pressure flows through the fuel passage 2 in the nozzle holder 1, the fuel passages 4 in the guide ring 3, the tangential grooves 6 and the swirl chamber 7 in the nozzle tip 5, and is injected through the nozzle opening 8 to form a conical fuel spray pattern as in the case of the conventional swirl type fuel atomizers.

According to a main feature of the present invention a plurality of sawtooth-shaped notches 18 are formed in the nozzle tip 5, with the notches having the shape as shown by the oblique view in FIG. 2. At the nozzle tip 5 having the sawtooth-shaped notches 18, the fuel, which forms a swirling stream by flowing from the tangential grooves 6 into the swirl chamber 7, is spurted out in the tangential direction from the notched side. Therefore it is possible to form divided spray groups on a predetermined substantially flat plane. The swirling fuel injected through the nozzle opening 8 is therefore sprayed along a plane containing the axis of the nozzle opening 8 and the spray line (the line connecting the points O and P in FIG. 2) without colliding against a relief line (the line connecting the points P and Q in FIG. 2). Thus the fuel is sprayed along separate planes containing the axis of the nozzle opening 8.

As described hereinbefore, the swirling type pressure fuel atomizers are capable of spraying the liquid fuel injected under pressure in the form of divided spray patterns so that a plurality of small flames are produced. As a result the overall surface area of the small flames is considerably increased so that the complete combustion with a relatively low temperature may be ensured. Therefore the production of nitrogen oxides may be substantially eliminated or reduced considerably. The emission of nitrogen oxides may be further eliminated or reduced because the high temperature gas or combustion products pass the flame within a very short time. Thus, opposed to the conventional fuel atomizers which produce a large and single flame with a high temperature with the result of the emission of a large quantity of nitrogenoxides, the fuel atomizers of the present invention may eliminate the air pollution problem.

The embodiments of the invention in which an exclusive property or privilege is claimed are defined as follows:

1. A burner assembly comprising a housing having a passage for receiving fuel at one end thereof, a nozzle tip extending from said housing and defining an outlet opening in communication with the other end of said passage, and means for imparting a swirl to said fuel as it passes to said nozzle tip for discharge through said outlet, said nozzle tip being frustro-conical in shape and having a plurality of sawtooth-shaped grooves formed therein, each groove defined by a first wall extending from the end of said tip and located in a plane including the longitudinal axis of the tip and a second wall which extends from the base of said first wall to the first wall of an adjacent groove, to divide the fuel discharging from said nozzle tip into a plurality of separate spray patterns.

2. The burner assembly of claim 1, wherein said grooves extend for the entire thickness of said nozzle tip.

3. The burner assembly of claim 1, wherein said grooves extend equi-angularly with respect to each other.

4. The burner assembly of claim 1, wherein said second wall of each groove extends in a substantially helical path from the base of said first wall to the first wall of an adjacent groove.

5. The burner assembly of claim 1, wherein said nozzle tip includes two sawtooth-shaped grooves with the first walls thereof spaced 180° apart.

* * * * *